US010597176B1

(12) United States Patent
Gavin

(10) Patent No.: US 10,597,176 B1
(45) Date of Patent: Mar. 24, 2020

(54) BALLOON FILLING AND TYING TOOL

(71) Applicant: Jared Gavin, Monticello, AR (US)

(72) Inventor: Jared Gavin, Monticello, AR (US)

( * ) Notice: Subject to any disclaimer, the term of this patent is extended or adjusted under 35 U.S.C. 154(b) by 232 days.

(21) Appl. No.: 15/787,868

(22) Filed: Oct. 19, 2017

(51) Int. Cl.

| | |
|---|---|
| ***B65B 3/00*** | (2006.01) |
| ***B65B 3/04*** | (2006.01) |
| ***B65B 7/02*** | (2006.01) |
| ***A63H 27/10*** | (2006.01) |

(52) U.S. Cl.
CPC ..... *B65B 3/04* (2013.01); *A63H 27/10* (2013.01); *B65B 7/02* (2013.01); *A63H 2027/105* (2013.01); *A63H 2027/1033* (2013.01); *A63H 2027/1083* (2013.01)

(58) Field of Classification Search
CPC .. B65B 3/04; B65B 7/02; A63H 27/10; A63H 2027/1033; A63H 2027/105; A63H 2027/1083
See application file for complete search history.

(56) References Cited

U.S. PATENT DOCUMENTS

| | | | | |
|---|---|---|---|---|
| 7,549,683 | B1 | 6/2009 | Sikorcin | |
| 8,141,326 | B2 | 3/2012 | Wang | |
| 8,307,612 | B1 | 11/2012 | Sikorcin | |
| 2010/0072750 | A1 | 3/2010 | Nance | |
| 2012/0085430 | A1* | 4/2012 | Johansson | A63H 27/10 137/231 |
| 2012/0097293 | A1 | 4/2012 | Dancescu et al. | |
| 2012/0144776 | A1 | 6/2012 | Sikorcin | |
| 2016/0059141 | A1 | 3/2016 | Plouffe | |
| 2016/0325150 | A1 | 11/2016 | Johnson et al. | |

OTHER PUBLICATIONS

Declaration of Jared Gavin Regarding Prior Disclosures, signed Dec. 29, 2017.

* cited by examiner

*Primary Examiner* — P. Macade Nichols
(74) *Attorney, Agent, or Firm* — Stinson LLP

(57) ABSTRACT

A balloon tool having a U-shaped body, first and second side walls extending outward from an end of the U-shaped body to form a slot between the side walls and the U-shaped body, and a tooth extending outward from the second side wall toward the first side wall to present a gap between a distal end of the tooth and the second side wall. The balloon tool is preferably configured for tying a knot in a balloon by sliding the neck of a balloon into the slot and through the gap, wrapping the neck of the balloon around the U-shaped body, inserting an end of the balloon between the U-shaped body and the portion of the neck wrapped around the U-shaped body, and sliding the neck of the balloon back out through the gap. The balloon tool preferably includes a hollow channel for filling a balloon with fluid.

17 Claims, 7 Drawing Sheets

BALLOON FILLING AND TYING TOOL

CROSS-REFERENCE TO RELATED APPLICATIONS

None.

STATEMENT REGARDING FEDERALLY SPONSORED RESEARCH OR DEVELOPMENT

Not applicable.

STATEMENT REGARDING JOINT RESEARCH AGREEMENT

Not applicable.

BACKGROUND OF THE INVENTION

1. Field of the Invention

The invention is related to a balloon tool, and more particularly to a balloon tool configured to assist in filling balloons with fluid, such as water, and to facilitate the quick and easy tying of a knot in the neck of the balloon in order to retain the fluid within the balloon.

2. Description of Related Art

Water balloon "fights" are a pastime enjoyed by both children and adults around the world. The typical balloon used for water balloons is formed of latex rubber, and thus easily expands when filled with water. The balloon bursts when it strikes a person or object with sufficient force, thus providing an "explosion" of water. Although balloons desired for filling with air or other gases may be used, balloons designed specifically as water balloons are preferred; these balloons have a thicker wall, which prevents them from being overfilled and thus becoming too large to effectively throw. A typical filled water balloon is ideally about the size of a baseball.

Water balloons may be quickly thrown, but filling the balloons requires some time. The filling process is typically considered unenjoyable, and a long delay for filling a batch of water balloons can cause children to lose interest in the activity. In addition, filling water balloons with a typical faucet or garden hose quickly becomes tiresome because the person performing this operation must repeatedly stretch the mouth of the balloon over the opening, hold the balloon in place as it fills, then pinch the water balloon closed while simultaneously tying a knot to seal the mouth closed. For most persons, this operation quickly leads to sore fingers and diminishes the enjoyment of the activity. There is thus a need for an invention that will spare a person's fingers from becoming raw during the filling and tying process, and also hasten the filling and tying process for the sake of increasing the enjoyment experienced from water balloon fights.

BRIEF SUMMARY OF THE INVENTION

One preferred embodiment of the invention disclosed herein is directed to a balloon tool having a U-shaped body, first and second side walls coupled with the U-shaped body, and a tooth coupled with the second side wall. The U-shaped body has first and second ends and first and second sides each extending from the first end to the second end. The first and second side walls are coupled with the first and second sides, respectively, of the U-shaped body at its second end, and the first and second side walls extend outward from the second end. A slot is positioned between the second end of the U-shaped body, the first side wall, and the second side wall. The tooth has a proximal end coupled with the second side wall and a distal end that is spaced a distance from the first side wall to form a gap between the distal end of the tooth and the first side wall.

A method of tying a balloon with the balloon tool includes steps of: inserting a neck of the balloon into the slot and through the gap between the distal end of the tooth and the first side wall; wrapping a portion of the balloon around the U-shaped body; inserting an end of the balloon between the U-shaped body and the portion of the balloon that is wrapped around the U-shaped body; and sliding the neck of the balloon back through the gap and out of the slot to form a knot in the neck of the balloon. The U-shaped body of the balloon tool facilitates the tying of a water balloon in a simple, quick manner.

The balloon tool preferably also includes a hollow channel extending within the U-shaped body from the first end to the second end and a hose coupling that is coupled to the first end of the U-shaped body. Preferably, the hose coupling is configured to engage a typical garden hose. The first and second side walls and second end of the U-shaped body is preferably sized and configured to be inserted into the open end of a balloon. In this configuration, the balloon tool may be used to fill a balloon with fluid, such as water. An opening of the balloon is placed over the first and second side walls, and a source of fluid is turned on to pass fluid through the hose, into the hollow channel of the U-shaped body, and into the opening of the balloon. When the balloon is filled to a desired extent with fluid, the first and second side walls are removed from the opening of the balloon, and the balloon may be tied in accordance with the procedure described above.

The balloon tool preferably also includes an elongate body that is coupled to the first end of the U-shaped body. The elongate body may be grasped by a user while using the balloon tool to fill and tie a balloon. A hose coupling may be coupled to the end of the elongate body, and the elongate body may have a hollow channel that is fluid communication with the hollow channel of the U-shaped body. Further, the balloon tool preferably comprises a protrusion that is coupled with a first half of the U-shaped body and that extends outward from the U-shaped body away from the first end and beyond an apex of the U-shaped body.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
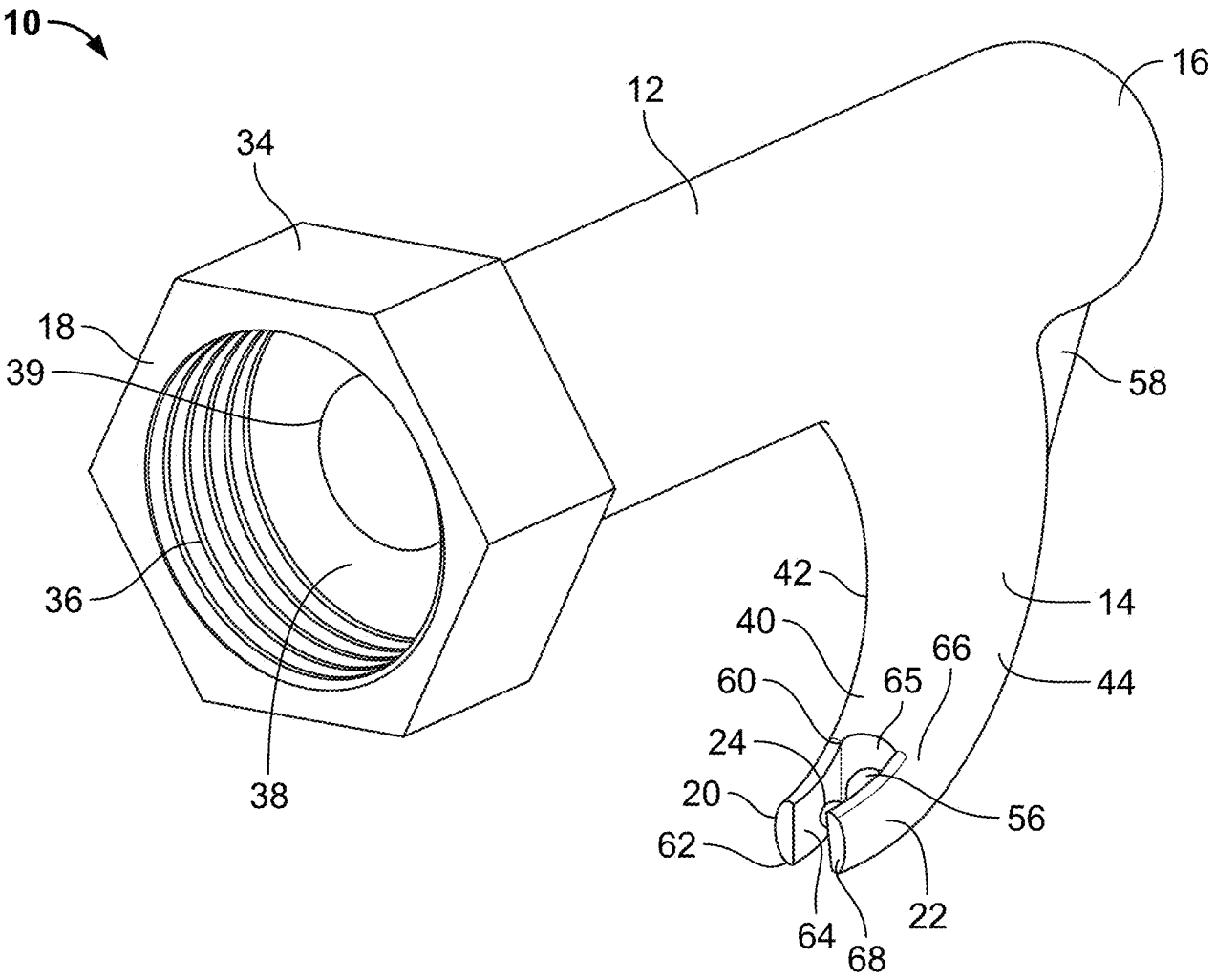
FIG. 1 is a perspective view of a balloon tool in accordance with one embodiment of the invention disclosed herein.
Figure 2:
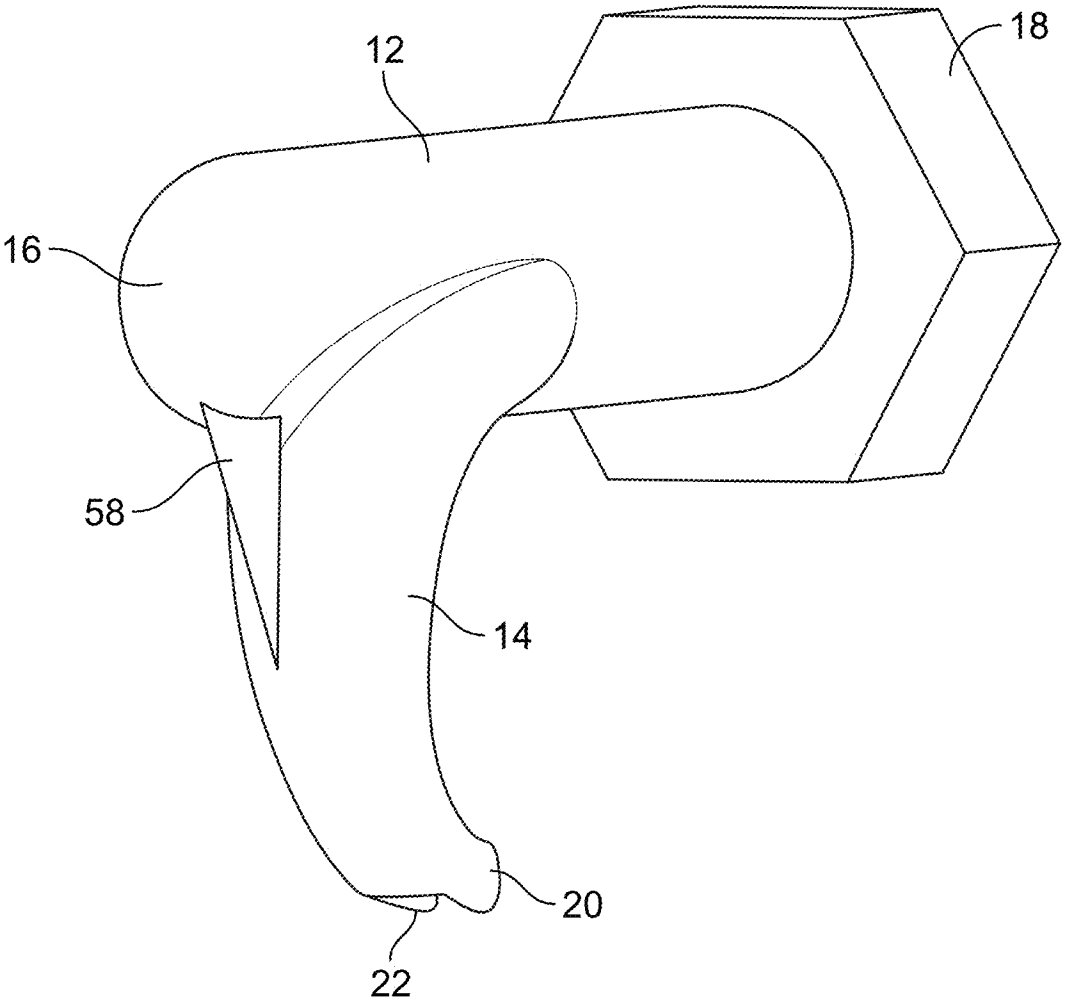
FIG. 2 is a rear perspective view of the balloon tool of FIG. 1.

A balloon tool in accordance with one embodiment of the invention disclosed herein is identified generally as 10 in FIG. 1. As described in detail herein, balloon tool 10 is configured to assist in filling a balloon with a fluid, such as water, and tying a knot in the neck of the filled balloon to prevent the fluid from leaking out. Balloon tool 10 includes an elongate body 12, a U-shaped body 14, a protrusion 16, a hose coupling 18, a first side wall 20, a second side wall 22, and a tooth 24.

Figure 3A:
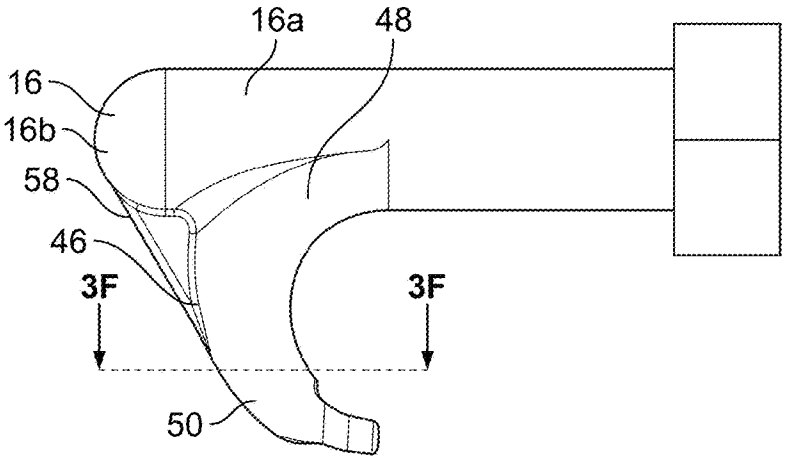
FIG. 3A is a side elevational view of the balloon tool of FIG. 1.
Figure 3C:
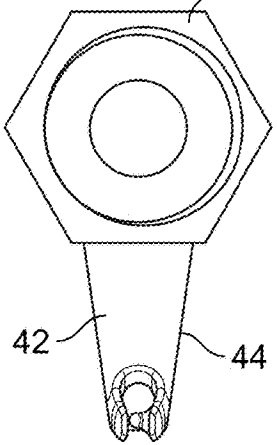
FIG. 3C is a front elevational view of the balloon tool of FIG. 1
Figure 3B:
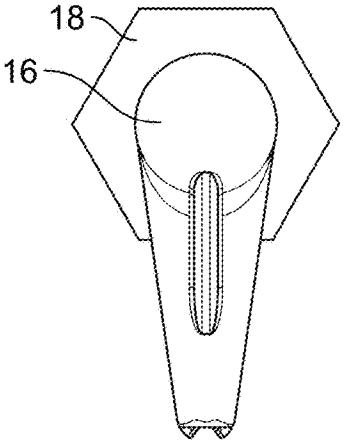
FIG. 3B is a rear elevational view of the balloon tool of FIG. 1.
Figure 3D:
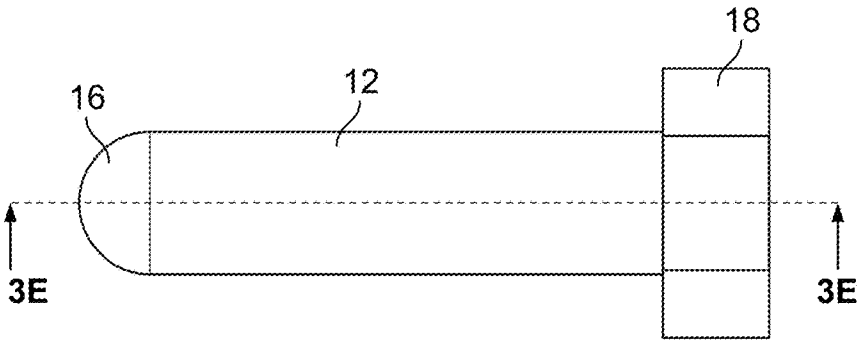
FIG. 3D is a top plan view of the balloon tool of FIG. 1.
Figure 3F:
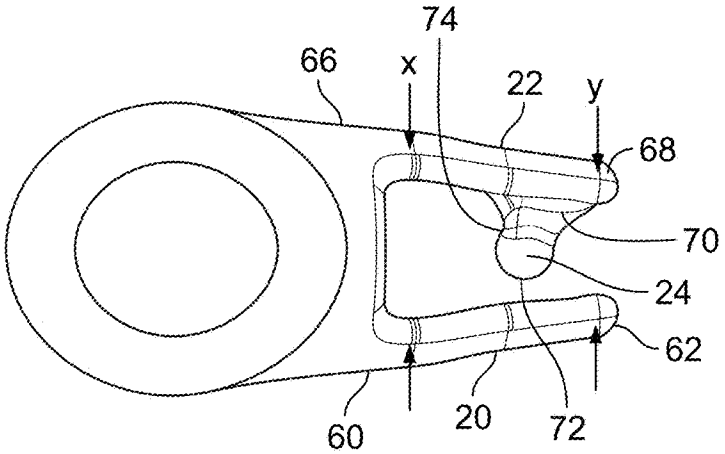
FIG. 3F is a cross-sectional view taken through the line 3F-3F of FIG. 3A.
Figure 3E:
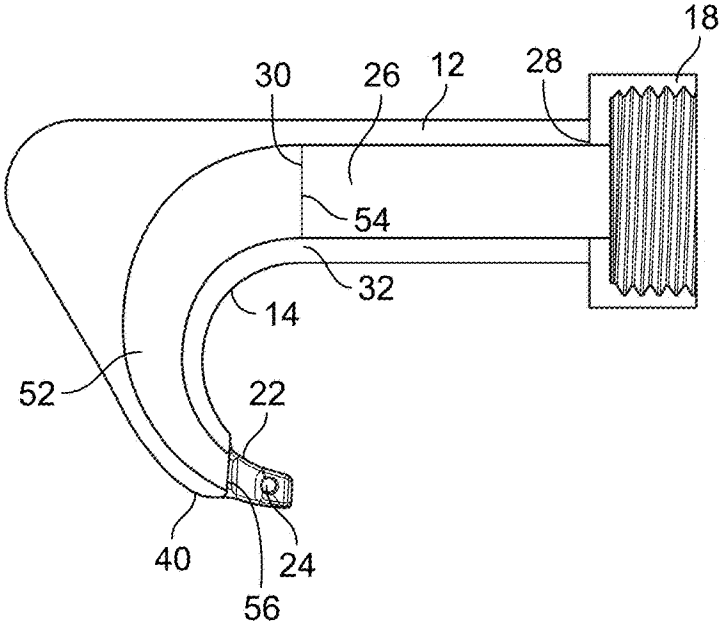
FIG. 3E is a cross-sectional view taken through the line 3E-3E of FIG. 3D.

As shown in FIG. 3E, elongate body 12 is a cylindrical tube having a hollow channel 26 extending through the center of the elongate body 12 along a longitudinal axis of the elongate body 12. The elongate body 12 has a first end 28 that is coupled with the hose coupling 18 and a second end 30 that is coupled with U-shaped body 14. The elongate body 12 extends away from a first end 32 of U-shaped body 14. The elongate body 12 may be gripped by the hand of a user during operation and extends away from U-shaped body 14 to provide space for the user to fill and tie a balloon using U-shaped body 14, as described below.

Referring to FIG. 1, hose coupling 18 has a hexagonal outer surface 34 designed to be easily gripped by a user's hand or by a tool. Hose coupling 18 has a cylindrical inner surface 36 with female threads formed therein. The threads of cylindrical inner surface 36 are preferably sized and configured to engage with the male threads at the end of a conventional garden hose. The cylindrical inner surface 36 surrounds an interior chamber 38 that is in fluid communication with the hollow channel 26 of elongate body 12 through a fluid inlet 39. An o-ring seal (not shown) may be positioned within the interior chamber surrounding fluid inlet 39 to form a seal between hose coupling 18 and a hose (not shown) engaged with the hose coupling 18. While hose coupling 18 is shown as being coupled with elongate body 12, it is also within the scope of the invention for elongate body 12 to be omitted and for hose coupling 18 to be directly coupled to the first end 32 of U-shaped body 14. Further, hose coupling 18 may be omitted from balloon tool 10 or substituted with another type of coupling configured to connect to a fluid source. Elongate body 12 and hose coupling 18 may also have different shapes than those disclosed above and shown in the drawings.

As shown in FIG. 3E, U-shaped body 14 includes the first end 32, which is coupled to elongate body 12, and a second end 40, which is coupled to first side wall 20 and second side wall 22. U-shaped body 14 has a first side 42, shown in FIG. 3C, and a second side 44 that each extend from first end 32 to second end 40. U-shaped body has an apex 46, shown in FIG. 3A, that is positioned approximately midway between first end 32 and second end 40. A first half 48 of U-shaped body 14 is positioned above apex 46, and a second half 50 is positioned below apex 46. The outer diameter of U-shaped body 14 gradually decreases in size from first end 32 to second end 40.

A hollow channel 52 is formed within U-shaped body 14 and extends from first end 32 to second end 40. U-shaped body 14 has a fluid inlet 54 at first end 32 and a fluid outlet 56 at second end 40. Fluid inlet 54 is in fluid communication with the hollow channel 52 of U-shaped body 14 and the hollow channel 26 of elongate body 12. Fluid outlet 56 is in fluid communication with the hollow channel 52 of U-shaped body 14. Fluid entering hose coupling 18 flows through the hollow channel 26 of elongate body 12, the hollow channel 52 of U-shaped body 14 and out through fluid outlet 56. The hollow channel 52 has a variable diameter that decreases in size from first end 32 to second end 40, as shown in FIG. 3E.

Protrusion 16, shown in FIG. 3A, is coupled with the first half 48 of U-shaped body 14 and extends outward from the U-shaped body 14 away from first end 32 and beyond apex 46. Protrusion 16 is solid such that it is not in fluid communication with the hollow channel 52 of U-shaped body 14. Protrusion 16 includes a first section **16*a* that is coupled with U-shaped body 14 and that is generally cylindrical. Protrusion 16 includes a second section 16*b* that is coupled with first section 16*a* and that is generally hemispherical. Protrusion 16 is generally aligned with elongate body 12 and extends away from U-shaped body 14 in a direction that is aligned with a central longitudinal axis of elongate body 12. A triangular shaped web 58 extends from approximately the apex 46 of U-shaped body 14 to the end of second section 16*b* of protrusion 16. As described in more detail below, protrusion 16 ensures that a balloon does not move around U-shaped body 14 toward elongate body 12 when the balloon is wrapped around U-shaped body 14** during the process of tying a knot in the balloon.

Referring to FIG. 1, first side wall 20 is coupled with the first side 42 of the U-shaped body 14 at the second end 40 of the U-shaped body 14. First side wall 20 extends outward from the second end 40. First side wall 20 has a first end 60 that is coupled to the U-shaped body 14 and a second end 62. Second side wall 22 is coupled with the second side 44 of the U-shaped body 14 at the second end 40 of the U-shaped body 14. Second side wall 22 extends outward from the second end 40 to form a slot 64 positioned between the second end 40 of the U-shaped body 14, the first side wall 20, and the second side wall 22. U-shaped body 14 includes an end surface 65 surrounding fluid outlet 56 that forms a root of slot 64. Second side wall has a first end 66 that is coupled to the U-shaped body 14 and a second end 68.

As shown in FIG. 3F, there is a first distance X between the first end 60 of the first side wall 20 and the first end 66 of the second side wall 22 and a second distance Y between the second end 62 of the first side wall 20 and the second end 68 of the second side wall 22. The first side wall 20 and the second side wall 22 taper toward each other as they extend outward from U-shaped body such that the first distance X is greater than the second distance Y.

Tooth 24 has a proximal end 70 that is coupled with second side wall 22 and a distal end 72. Tooth 24 is positioned within slot 64 and extends outward from second side wall 22 toward first side wall 20. Distal end 72 of tooth 24 is spaced a distance from first side wall 20 to form a gap between the distal end 72 of the tooth 24 and the first side wall 20. Distal end 72 of tooth 24 is hemispherical with a convex outer surface. Tooth 24 extends slightly toward U-shaped body 14 from proximal end 70 to distal end 72 of tooth 24 such that the distal end 72 is closer to the U-shaped body 14 than the proximal end 70. Tapering tooth 24 slightly toward U-shaped body 14 in this manner assists in guiding the neck of a balloon into slot 64 and through the gap between the distal end 72 of tooth 24 and first side wall 20. Tooth 24 has a concave interior surface 74 facing the U-shaped body 14. All exterior surfaces of tooth 24 are preferably smooth with no ridges or edges to prevent tearing a hole in a balloon that contacts tooth 24.

The elongate body 12, U-shaped body 14, protrusion 16, hose coupling 18, first side wall 20, second side wall 22, and tooth 24 may be integrally formed together from the same material, for example, by molding. Alternatively, any one or more of these components of balloon tool 10 may be formed separate from the remaining components and then joined together as shown in the drawings in any suitable manner.

In use, balloon tool 10 is configured for filling a balloon with a fluid, such as water, and tying the end of the balloon to prevent the fluid from escaping through the open end of the balloon. Balloon tool 10 is preferably used with a conventional latex rubber water balloon, but may be adapted for use with any type of suitable balloon. A balloon is filled with fluid using balloon tool 10 by first connecting a conventional garden hose to hose coupling 18. The first side wall 20 and second side wall 22 of balloon tool 10 are then inserted through the opening at the end of the balloon. The balloon tool 10 may be inserted through the opening of the balloon until the balloon covers the fluid outlet 65 shown in FIG. 1. The source of water is then turned on allowing water to flow through the hose, balloon tool 10 and into the balloon. Once the balloon is filled with a desired amount of water, the balloon is removed from the end of the balloon tool 10.

Figure 4B:
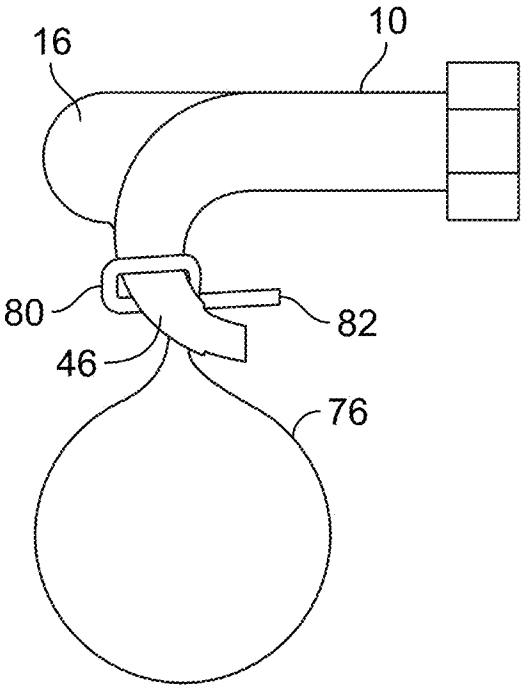
FIGS. 4A-4F show a process of tying a balloon using the balloon tool of FIG. 1.
Figure 4A:
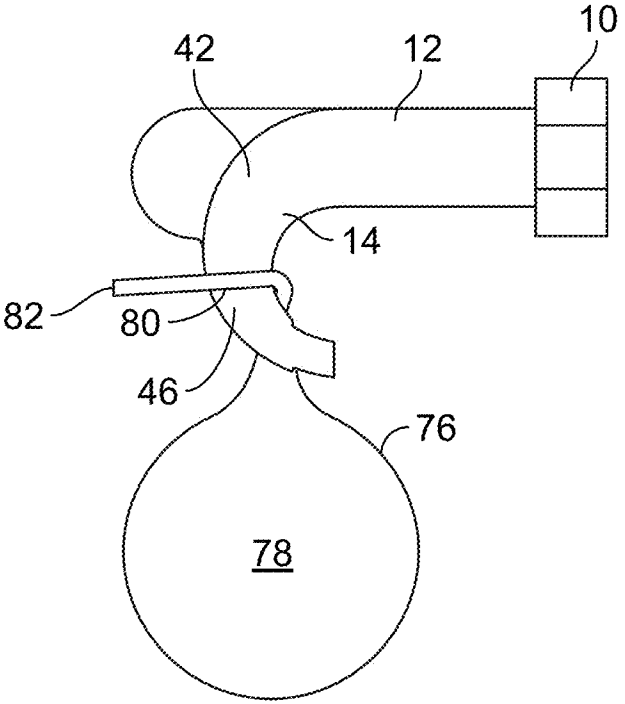

Balloon tool 10 may then be used to tie a knot in the end of the balloon in accordance with the steps shown in FIGS. 4A-4F. First, as shown in FIG. 4A, the balloon tool 10 is oriented so that elongate body 12 is generally horizontal and U-shaped body 14 extends below elongate body 12. The balloon 76 is oriented so that the spherical end portion 78 of balloon 76 containing the water is positioned below balloon tool 10. A neck 80 of balloon 76, which extends from the spherical end portion 78 to an open end 82 of the balloon 76, is inserted into the slot 64 (FIG. 1) between the first side wall 20 and the second side wall 22. The neck 80 of balloon 76 slides through the gap between the distal end 72 of tooth 24 and the first side wall 20. The neck 80 of the balloon 76 may be positioned to contact the concave interior surface 74 of tooth 24, which helps retain the neck 80 of the balloon 76 within the slot 64 as the neck 80 is tied into a knot. When the neck 80 is positioned within slot 64, the neck 80 and open end 82 of balloon 76 are wrapped over the first side of 42 of U-shaped body 14 at approximately the apex 46 of U-shaped body 14. The neck 80 is approximately horizontal at the completion of this step and extends away from the spherical end portion 78 at approximately a 90 degree angle.

Next, as shown in FIG. 4B, the neck 80 and open end 82 of balloon 76 are wrapped 180 degrees around the U-shaped body 14 so that the neck 80 wraps around the apex 46 of the U-shaped body 14 and partially covers the second side 44 of the U-shaped body 14. The neck 80 is approximately horizontal at the completion of this step and the open end 82 extends away from U-shaped body 14 in the opposite direction as at the end of the step shown in FIG. 4A. Protrusion 16 assists in retaining the neck 80 of balloon 76 wrapped around the apex 46 of U-shaped body 14 by preventing the neck 80 from moving upward toward elongate body 12.

Figure 4D:
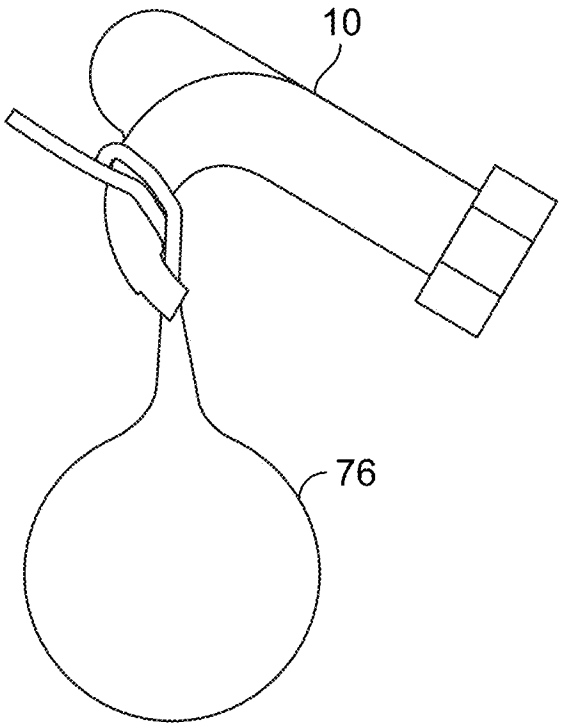
Figure 4C:
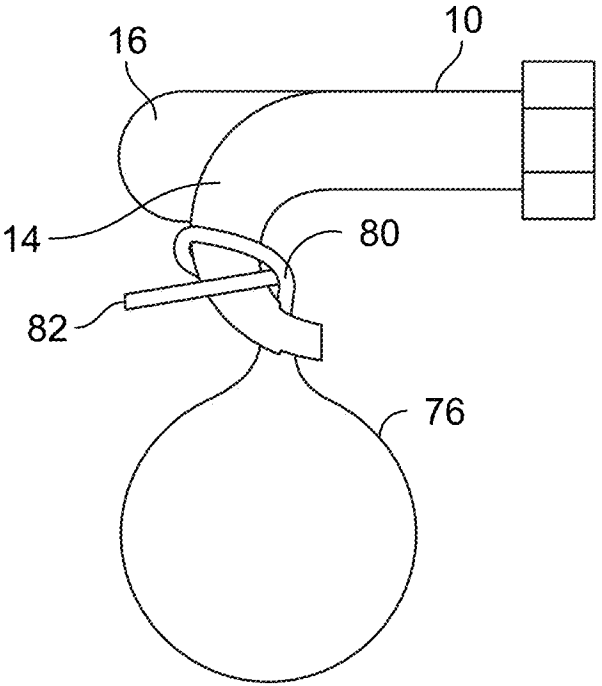

Then, as shown in FIG. 4C, the open end 82 of balloon 76 is inserted through the opening between U-shaped body 14 and the portion of neck 80 that is wrapped around the first side 42 of U-shaped body 14. The open end 82 of balloon 76 is pulled through this opening to begin forming a knot in the neck 80 of balloon 76. The neck 80 of balloon 76 completely encircles U-shaped body 14 at the completion of this step.

Figure 4F:
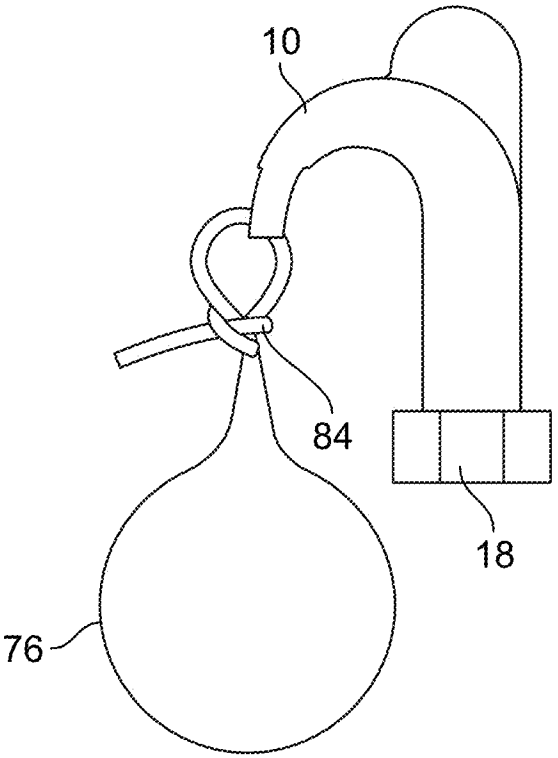
Figure 4E:
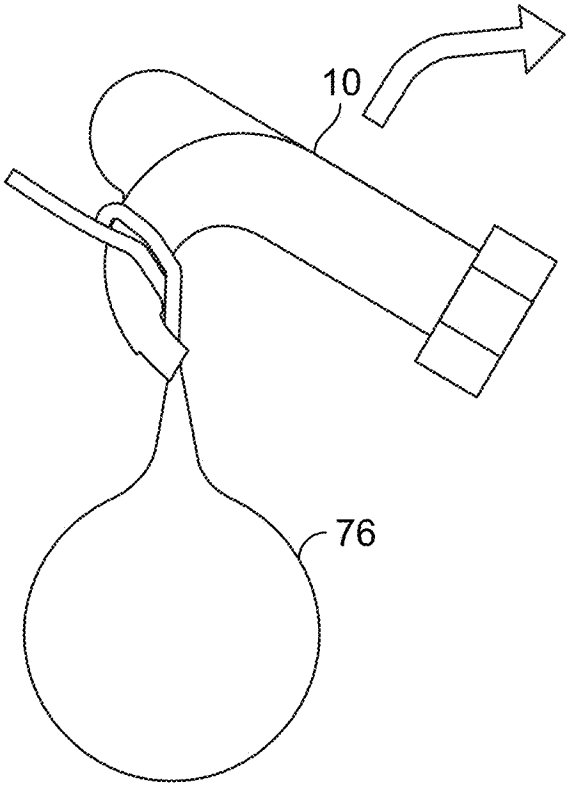

Balloon tool 10 is then rotated 90 degrees, as shown in FIGS. 4D-4F, until hose coupling 18 faces down. The user then slides the neck 80 of the balloon 76 back through the gap between the distal end 72 of tooth 24 and the first side wall 20 and out of the slot 64. Gravity assists the user in sliding the neck 80 of the balloon 76 past the tooth 24 and out of the slot 64. When the balloon 76 is released from the balloon tool 10, a knot 84 is formed in the neck 80 of the balloon 76 to prevent the fluid within balloon 76 from leaking out of the open end 82 of the balloon 76.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. For example, balloon tool 10 may be solid with no hollow channels extending through it, in which case balloon tool 10 would only be used for tying a balloon and not filling the balloon with water. In such an embodiment, hose coupling 18 may be omitted. Further, it will be understood that certain features and subcombinations are of utility and may be employed without reference to other features and subcombinations. This is contemplated by and is within the scope of the claims.

What is claimed and desired to be secured by Letters Patent is as follows:

1. A balloon tool comprising:

a U-shaped body comprising a first end and a second end, wherein the U-shaped body further comprises a first side and a second side each extending from the first end to the second end;

a first side wall coupled with the first side of the U-shaped body at the second end of the U-shaped body, wherein the first side wall extends outward from the second end;

a second side wall coupled with the second side of the U-shaped body at the second end of the U-shaped body, wherein the second side wall extends outward from the second end to form a slot positioned between the second end of the U-shaped body, the first side wall, and the second side wall; and a tooth comprising a proximal end coupled with the second side wall and a distal end, wherein the tooth extends outward from the second side wall toward the first side wall, and wherein the distal end of the tooth is spaced a distance from the first side wall to form a gap between the distal end of the tooth and the first side wall.

2. The balloon tool of claim 1, wherein the U-shaped body comprises a hollow channel extending from the first end to the second end, wherein the U-shaped body comprises a fluid inlet at the first end, and wherein the U-shaped body comprises a fluid outlet at the second end.

3. The balloon tool of claim 2, further comprising a hose coupling that is coupled to the first end of the U-shaped body.

4. The balloon tool of claim 2, further comprising an elongate body coupled to and extending away from the first end of the U-shaped body.

5. The balloon tool of claim 4, wherein the elongate body comprises a hollow channel that is in fluid communication with the hollow channel of the U-shaped body.

6. The balloon tool of claim 5, further comprising a hose coupling that is coupled to the elongate body.

7. The balloon tool of claim 2, wherein the hollow channel has a diameter that decreases in size from the first end to the second end.

8. The balloon tool of claim 1, wherein the U-shaped body comprises an apex positioned between the first end and the second end, and wherein the U-shaped body comprises a first half positioned above the apex and a second half positioned below the apex.

9. The balloon tool of claim 8, further comprising a protrusion coupled with the first half of the U-shaped body, wherein the protrusion extends outward from the U-shaped body away from the first end and beyond the apex.

10. The balloon tool of claim 1, wherein the first side wall comprises a first end that is coupled to the U-shaped body and a second end, wherein the second side wall comprises a first end that is coupled to the U-shaped body and a second end, wherein there is a first distance between the first end of the first side wall and the first end of the second side wall, wherein there is a second distance between the second end of the first side wall and the second end of the second side wall, and wherein the first distance is greater than the second distance.

11. The balloon tool of claim 1, wherein the distal end of the tooth is hemispherical with a convex outer surface.

12. The balloon tool of claim 1, wherein the tooth extends toward the U-shaped body from its proximal end to its distal end such that the distal end of the tooth is closer to the U-shaped body than the proximal end.

13. The balloon tool of claim 1, wherein the tooth comprises an interior surface facing the U-shaped body, and wherein the interior surface is concave.

14. A method of tying a balloon with a balloon tool comprising a U-shaped body comprising a first end and a second end, wherein the U-shaped body further comprises a first side and a second side each extending from the first end to the second end; a first side wall coupled with the first side of the U-shaped body at the second end of the U-shaped body, wherein the first side wall extends outward from the second end; a second side wall coupled with the second side of the U-shaped body at the second end of the U-shaped body, wherein the second side wall extends outward from the second end to form a slot positioned between the second end of the U-shaped body, the first side wall, and the second side wall; and a tooth comprising a proximal end coupled with the second side wall and a distal end, wherein the tooth extends outward from the second side wall toward the first side wall, and wherein the distal end of the tooth is spaced a distance from the first side wall to form a gap between the distal end of the tooth and the first side wall, the method comprising:

inserting a neck of the balloon into the slot and through the gap between the distal end of the tooth and the first side wall;

wrapping a portion of the balloon around the U-shaped body after the step of inserting the neck of the balloon into the slot;

inserting an end of the balloon between the U-shaped body and the portion of the balloon that is wrapped around the U-shaped body; and sliding the neck of the balloon back through the gap and out of the slot to form a knot in the neck of the balloon.

15. The method of claim 14, further comprising rotating the balloon tool so that gravity assists in sliding the neck of the balloon tool back through the gap and out of the slot.

16. The method of claim 14, wherein the U-shaped body comprises a hollow channel extending from the first end to the second end, wherein the U-shaped body comprises a fluid inlet at the first end, and wherein the U-shaped body comprises a fluid outlet at the second end, and further comprising the steps of:

inserting the first and second side walls of the balloon tool through an opening in the balloon; and passing fluid through the hollow channel of the U-shaped body and into the balloon.

17. The method of claim 16, wherein the balloon tool further comprises a hose coupling that is coupled to the first end of the U-shaped body, and further comprising the steps of:

coupling a hose to the hose coupling; and passing fluid through the hose into the U-shaped body.

* * * * *